US005332473A

United States Patent [19]

Ferguson

[11] Patent Number: 5,332,473

[45] Date of Patent: Jul. 26, 1994

[54] VESICULATED POLYMER GRANULES AND PAPER MADE THEREFROM

[75] Inventor: Loreen D. Ferguson, Mississauga, Canada

[73] Assignee: ICI Canada Inc., Ontario, Canada

[21] Appl. No.: 973,525

[22] Filed: Nov. 9, 1992

Related U.S. Application Data

[63] Continuation of Ser. No. 735,690, Jul. 29, 1991, abandoned, which is a continuation of Ser. No. 410,466, Sep. 21, 1989, abandoned.

[51] Int. Cl.[5] ..... D21H 17/74

[52] U.S. Cl. ..... 162/164.1; 162/168.1; 162/168.7; 162/169; 162/181.1; 162/181.2

[58] Field of Search ..... 162/168.1, 168.7, 169, 162/164.1, 166, 169, 181.1, 181.2; 106/409, 464, 465

[56] References Cited

U.S. PATENT DOCUMENTS

| | | | |
|---|---|---|---|
| 3,004,884 | 10/1961 | Eberl et al. | 162/166 |
| 3,037,903 | 6/1962 | Baumann et al. | 162/166 |
| 3,822,224 | 7/1974 | Gillan et al. | 260/2.5 N |
| 4,089,819 | 5/1989 | Coates et al. | 260/2.5 N |
| 4,137,380 | 1/1979 | Gunning et al. | 521/62 |
| 4,154,923 | 5/1979 | Braun | 528/485 |
| 4,321,332 | 3/1982 | Beresford et al. | 523/502 |
| 4,483,945 | 11/1984 | Beresford et al. | 521/62 |
| 4,808,633 | 2/1989 | Ferguson et al. | 521/63 |

FOREIGN PATENT DOCUMENTS

| | | | |
|---|---|---|---|
| 2358502 | 3/1978 | France | 162/168.1 |

OTHER PUBLICATIONS

"A New Class of Pigments", R. W. Kershaw, Australian OCCA Proceedings & News, Aug., 1971, p. 4.

G. Treier, TAPPI, vol. 55, No. 5, 1972, p. 769 "Development Of A Unique Lightweight Paper".

*Primary Examiner*—Peter Chin

*Attorney, Agent, or Firm*—Cushman, Darby & Cushman

[57] ABSTRACT

An alkaline paper comprising polymeric vesiculated granules, calcium carbonate, and fibrous materials. Alkaline papers made according to the present invention have improved physical properties.

7 Claims, 6 Drawing Sheets

PCC=Precip. Calcium Carbonate PVG=Polymeric Vesiculated Granules

C PCC
△ PCC+PVG
* PCC+TiO2
BURST INDEX (KPa.m2/g)
1.2
1.0
0.8
0.6
0.4
0.2
10
12
14
16
18
20
22
24
% FILLER IN SHEET
PCC=Precip. Calcium Carbonate PVG=Polymeric Vesiculated Granules C PCC
△ PCC+PVG
* PCC+TiO2
TEAR INDEX (mn.m2/g)
16
14
12
10
8
6
10
12
14
16
18
20
22
24
% FILLER IN SHEET
PCC=Precip. Calcium Carbonate PVG=Polymeric Vesiculated Granules

VESICULATED POLYMER GRANULES AND PAPER MADE THEREFROM

This is a continuation of application Ser. No. 07/735,690, filed on Jul. 29, 1991, now abandoned, which is a file wrapper continuation of application Ser. No. 07/410,466, filed Sep. 21, 1989, now abandoned.

This invention relates to vesiculated polymer granules and more particularly, to paper comprising said granules.

The development of paper having a high opacity, low cost and acceptable physical properties has always been of interest to paper manufacturers.

Paper is typically manufactured by transferring a suspension (or furnish) of fibrous material, sizing materials, wet and dry strength additives, defoamers, biocides, dyes, pigments, retention aids and/or fillers, to a forming wire for water drainage to concentrate solids. The paper formed on the wire is subsequently dried to a desired basis weight (weight per unit area).

The fibrous material used in papermaking is cellulosic or non-cellulosic in form, e.g. plant matter, such as trees, cotton, bagasse, and synthetic polymers, such as rayon, which may have been delignified and/or bleached.

Fillers are normally added during paper production in order to replace a portion of the expensive pulp fibres with less expensive material. The fillers of choice for alkaline paper, which in this specification means any paper produced from an aqueous fibrous suspension of pH 7 or greater, are usually selected from the class of mineral fillers known as clays, such as kaolin, and calcium carbonates.

The calcium carbonates of use as paper making fillers fall under three classifications, namely, ground, chalk and precipitated carbonates. Ground calcium carbonates occur naturally in the earth and are mined and milled to a desired particle size. The chalk form of calcium carbonate is the skeletal remains of marine organisms, while the precipitated calcium carbonate is a man-made form of calcium carbonate prepared by bubbling carbon dioxide gas through an aqueous slurry of calcium hydroxide, followed by precipitation of the calcium carbonate produced.

Calcium carbonate is not used in acidic paper making because calcium carbonate would cause foaming in the acidic aqueous paper composition due to the production of carbon dioxide.

Fillers are also generally used to impart suitable optical properties, namely, whiteness, brightness, opacity, and colour, and surface properties, such as, smoothness and printability.

The degree of opacity of a particular substrate is the result of diffuse light-scattering which occurs when visible radiation is reflected from particles on the surface of the substrate and the substrate medium itself. In alkaline papermaking, it is customary to use the inorganic mineral fillers mentioned hereinabove, and in particular calcium carbonate, to enhance the optical and surface properties of paper sheets.

However, there is a practical limit to the amount of inorganic mineral filler which can be added to the paper. As the inorganic mineral filler content increases, there is a substantial loss of the physical strength properties of the paper. This loss of physical properties results because of interference with the hydrogen bonding between the strands of fibrous material, by the filler, and because with increased inorganic mineral filler content there is less fiber present in the paper sheet to contribute to the strength.

These physical properties, such as burst index, tensile index, tear index, % elongation, break length and tensile energy absorption (TEA) index are important considerations in paper manufacture because papers with unacceptably low physical properties will be prone to tearing on the paper making machine or during the printing process, or will be below accepted standards for that grade of paper.

Improvements in one physical property, for example tear strength, can usually be achieved by sacrificing another physical property, such as tensile strength, but it is unusual to discover an economical method to improve all physical properties simultaneously. For optimum performance, particularly on the paper making machine, a blend of good physical properties is desired. Accordingly, paper manufacturers operate with a paper formulation that will give an optimum blend of physical properties and will minimize their expense while maximizing production.

During paper making, deteriorations in physical properties are generally noticed as the level of filler increases. Filler levels used in alkaline papermaking are significantly higher than in acidic papermaking, because of the economic benefits of using high quantities of relatively low priced calcium carbonate filler. As a result of these higher filler levels, the loss of physical properties is of greater concern in alkaline papermaking than in acidic papermaking.

It is already known in the papermaking art that vesiculated granules of carboxylated unsaturated polyester crosslinked with ethylenically unsaturated monomer can confer advantageous properties, such as improved opacity to paper and coating compositions in which they are incorporated. The background to the use of vesiculated granules in papermaking is well covered in the literature, for example, in articles by Kershaw (Australian OCCA Proceedings and News, Aug. 1971), and Treier (TAPPI, Vol. 55, No. 5, 1972). Numerous patents relating to these vesiculated granules have also been issued, which include U.S. Pat. Nos. 3,822,224, 4,089,819, 4,137,380, 4,321,332, 4,483,945, Canadian Patent No. 1,139,048 and European Patent application Ser. Nos. 0,204,916 and 0,268,729.

The technique of preparing vesiculated polyester granules has been known for some time and the preferred process of preparation of said granules is new well established. This process is the "double emulsion" process wherein water is first dispersed in a solution of a carboxylated unsaturated polyester in a polymerizable monomer, to give a "first emulsion", and the first emulsion is itself dispersed in water to give a "double emulsion". Free radical polymerization is then initiated to give vesiculated granules of cross-linked polyester resin. If pigmented vesiculated granules are required, pigment may be dispersed in either or both of the first emulsion components using conventional pigment dispersants and defoamers. The technique of preparing vesiculated materials is discussed in detail in U.S. Pat. No. 4,808,633, assigned to C-I-L Inc.

EP-0,204,916 and EP-0,268,729, describe methods for producing high bulk calendered paper containing vesiculated beads. EP-0,204,916 describes a high bulk calendered paper wherein the opacity of the paper is increased by the addition of vesiculated granules in the amount of 0.5 to 15%, and preferably 2 to 10%, by weight of the paper produced. Papers produced according to EP-0,204,916 have increased thickness and resistance to print show through, while the brightness and opacity of the paper is maintained. This allows the amount of titanium dioxide pigment to be reduced, which lowers the cost of the resulting paper.

EP-0,268,729 describes a similar paper as in EP-0,204,916 with increased thickness and resistance to print show through while maintaining brightness and opacity, wherein the polymeric vesiculated granule concentration is between 2 and 6%, and preferably 4 and 6%, of the total paper weight. In a preferred feature of the invention, a neutralized polycarboxylic acid polymer thickener is added to reduce the proportion of fines which pass through the paper forming wire.

Both EP-0,268,729 and EP-0,204,916 describe paper compositions prepared from acidic furnishes. In EP-0,268,729, it is preferred that the aqueous furnish has a pH of from 4 to 6. Both patent applications also state that physical properties are maintained by the replacement of titanium dioxide with polymeric vesiculated granules. However, both patents are silent on the use of polymeric vesiculated granules in an alkaline paper composition, and in particular, paper compositions which comprise calcium carbonate filler.

We have now found that the physical properties of an alkaline paper which comprises calcium carbonate filler, can be improved by the addition of polymeric vesiculated granules. These improved physical properties, evident in a typical alkaline paper containing 5 to 35% calcium carbonate, are achieved at a granule concentration of 1 to 10% by weight.

The improvement, according to the present invention, that has been observed in the physical properties of alkaline paper, allows the paper maker to lower the cost of the paper produced by either adding additional calcium carbonate and, thus, replacing additional expensive fibrous material while maintaining constant physical properties; or by increasing the line speed of the paper machine, because of the improved physical properties of the paper, and thus producing additional paper per unit time.

It is an object of this invention to provide alkaline paper having improved physical properties.

It is a further object of the present invention to improve the physical properties of an alkaline paper which contains calcium carbonate while maintaining or improving the opacity of said paper.

Accordingly, the present invention provides an alkaline paper as hereinbefore defined, comprising a fibrous cellulosic material; 1.0 to 10.0%, by weight of the paper, of polymeric vesiculated granules; and 5 to 35% by weight of paper, of calcium carbonate filler.

Preferably, the invention provides an alkaline paper as hereinbefore defined wherein said alkaline paper comprises 1 to 5% of said polymeric vesiculated granules.

More preferably, the invention provides an alkaline paper as hereinabove defined wherein said calcium carbonate level is between 10 and 25% by weight of paper.

In regards to the calcium carbonate fillers of use in the practice of this invention, precipitated or ground calcium carbonates are preferred, with precipitated calcium carbonate being the most preferred.

In addition to calcium carbonate, other fillers, pigments, extenders and/or opacifiers such as titanium dioxide, clay and talc may be added to the paper suspension in accordance with the papermaking prior art or may be added to the vesiculated granule during production of the granule.

By vesiculated polymer granules is meant granules of polymer, preferably spheroidal granules, which have a cell-like structure, the walls of which are provided by the polymer. The granules comprise a plurality of cells or vesicles (that is they are not mono-cellular or balloon-like) and although the vesicles are not necessarily of uniform size, the ratio of the diameter of the granule to the mean individual vesicle diameter is generally at least 5:1. The vesicles typically occupy from 5 to 95% of the total volume of the granules and the maximum diameter of the vesicles is 20 microns. Low vesicle volumes are usually associated with granules of high mechanical strength which are particularly useful for some applications, but to achieve the most useful opacifying effects the vesicles typically occupy at least 20% of the total volume of the granules, preferably 20–75% of the volume Therefore, in a preferred embodiment, the invention provides an alkaline paper as described hereinabove wherein said granules have a mean diameter of 1 to 100 microns, the ratio of the granule to the mean vesicle diameter is at least 5:1, the maximum diameter of the vesicles is 20 microns, and the volume of the vesicles is from 5 to 95% of the volume of the granule.

The granules have substantially continuous, solid walls and have a preselected and targeted particle size. Broadly, the granules may have a mean diameter of 1 to 100 microns. In general we find that granules having a mean diameter of 1 to 50 microns are of the most value as opacifying agents.

It is also customary to incorporate in the dilute paper furnish, immediately prior to formation on the wire, small amounts of polyelectrolyte retention aids to give improved retention of the inorganic mineral fillers and any fine fractions of the cellulosic materials on the wire during sheet formation. In alkaline papermaking it is customary to use a dual retention aid system. A cationic retention aid is used to prepare or "condition" the furnish prior to the addition of an anionic retention aid. The dual retention aid system is usually comprised of polymeric polyelectrolytes, e.g. polyacrylamides and polyethyleneimines.

It is also possible to obtain retention in alkaline furnishes using a single polymeric retention aid, for example polyacrylamide.

A further aspect of the present invention is the alkaline aqueous compositions, which in this specification means any a composition of pH 7 or greater used, in the preparation of the papers of the present invention, described hereinabove.

Accordingly, the invention further provides an alkaline aqueous composition comprising a fibrous material, 1.0 to 10% of polymeric vesiculated granules, and 5 to 35% of calcium carbonate filler wherein the percentages expressed are as percentages by weight of the resultant paper produced from said composition.

The aqueous slurry of vesiculated polyester granules that is formed according to the technique described in U.S. Pat. No. 4,808,633 may be used directly in paper wet-end applications. The aqueous slurry of vesiculated polyester granules may also be dewatered, by any convenient means, for example by the method described in U.S. Pat. No. 4,154,923 and subsequently redispersed in an aqueous or non-aqueous medium, before being incorporated into the paper furnish.

The pulp component of the alkaline paper to be produced can be formed in part or totally from hardwood, softwood and recycled pulps and/or broke if desired, incorporating an internal sizing agent, for example, alkyl ketene dimer emulsion, or alkyl succinic anhydride.

In general, we have found for the purposes of this invention that the upper limit of usefulness for the vesiculated polymeric granules to be 10 weight percent of the total paper solids. Because of the cost of the polymeric vesiculated granules and because of a diminishing improvement in physical properties at higher levels of granules, it is preferred that the level of granules be less than 5 weight percent and even more preferably less than 3 weight percent.

The invention is further described with reference, by way of example only, to the following examples in which all parts are expressed by weight.

EXAMPLE 1

Pigmented vesiculated polyester resin granules having a 10 micron (95 percentile) diameter maximum, 5.2 micron mean average diameter of use in the practice of the present invention were prepared according to the technique of Example 1 of U.S. Pat. No. 4,808,633 but with the following formulation.

| Group | Material | Parts (w/w) |
|---|---|---|
| A | water | 3.088 |
| | surfactant (1) | 1.595 |
| | antifoam (2) | 0.016 |
| B | titanium dioxide pigment (3) | 10.601 |
| C | water | 1.029 |
| D | polyester (4) | 8.686 |
| | styrene | 4.817 |
| | magnesium oxide | 0.045 |
| E | water | 1.647 |
| F | hydroxy ethyl cellulose (5) | 4.117 |
| | poly(vinyl alcohol) solution (6) | 6.175 |
| | surfactant (1) | 0.103 |
| | water | 30.934 |
| G | water | 24.701 |
| H | cumene hydroperoxide | 0.206 |
| | diethylene triamine | 0.051 |
| | ferrous sulphate | 0.003 |
| I | bactericide (7) | 0.021 |
| | ammonia solution (8) | 0.165 |
| | thickener (9) | 2.000 |

(1) A 28% wt. solids ammonium salt of a sulphated alkylpenoxypoly(ethyleneoxy)-ethanol (ex. GAF Corp. Alipal* CO-436)
(2) Antifoam Foamaster* NSI (ex Diamond Shamrock) or Bevaloid* 60 (ex. Imperial Chemical Industries PLC)
(3) Titanium dioxide piment TiPure* R900 (ex. DuPont)
(4) A 65% weight solids solution of a 3.74/2.34/0.912 (molar) propylene glycol/-maleic anhydride/phthalic anhydride solution in styrene.
(5) A 1.5% weight solids aqueous solution of Natrosol* 250HR (ex. Hercules)
(6) A 7.5% weight solids aqueous solution of Poval* 224G.
(7) Bactericide Proxel* GXL (ex. Imperial Chemical Industries PLC).
(8) A commercially available concentrated 0.9 ammonia solution.
(9) Acrysol* ASE-60 (ex. Rohm & Haas)
*trade mark Table A outlines some of the physical parameters of the granules obtained.

TABLE A

| Property | 10 micron Pigmented Vesiculated Granules |
|---|---|
| Density of dried granules | 0.59 g/ml |
| % vesiculation (1) | 65% |
| Weight solids | 21.2% |
| Volume solids | 36% |
| Maximum granule size (2) | 12 microns |
| Median granule size | 5.2 microns |
| Minimum granule size | 3 microns |
| Vesicle pore size (3) | 0.5–3.0 microns |
| Surface pores on granule | <0.2 microns |
| Thickness of granule wall | 0.1–0.5 micron |

Note:
(1) vesiculation determined by mercury porisimetry
(2) granule size determined by Laser Diffraction Granulometer
(3) internal diameters measured using Scanning Electron Microscopy In these examples the following terms are used:

Freeness of pulp is a measure of the drainage rate of water through the pulp and is measured in accordance with the TAPPI (Technical Association of Pulp and Paper Industry) Standard T 227 om-75 and is referred to as Canadian Standard Freeness, measured in milliliters;

Opacity of the paper sheet is expressed as a contrast ratio opacity (C/R Opacity) and measured in accordance with TAPPI Standard T 425 om-81 using light with a wavelength of 572 nanometers;

The term handsheet is used to refer to a paper sheet made in accordance with and employing the equipment described in the TAPPI standard T 205 om-81; and Conditioning refers to the conditioning atmosphere of 23.0° C. +/−1° C., and 50.0% +/−2.0% relative humidity that the paper sheets are exposed to in accordance with TAPPI standards T 405 om-83.

Handsheets, as discussed hereinbelow in Example 2 were prepared by the following general procedure.

The solids in the final pulp slurrys were comprised of fully bleached kraft hardwood or softwood pulps that had been soaked in water for four hours and were refined to a Canadian Standard Freeness (CSF) of 400 or 600 mls. After refining, the pulps were mixed together and then divided into individual samples of pulp calculated to give a target basis weight when combined with the fillers. The pulp samples were dispersed in water, and cationic polymeric retention aid was added. The addition of fillers, including the calcium carbonate and the polymeric vesiculated granules, was followed by the addition of the anionic polymeric retention aid. The pH of the furnish was controlled to 7.8 to 8.2 by the addition of dilute sodium hydroxide as required.

The furnish was subsequently passed through a sheetmaker and the resultant handsheet pressed and conditioned.

EXAMPLE 2

The hereinabove general procedure for the preparation of handsheets was carried out to prepare a number of different samples for testing of physical properties. The furnish comprised a fully bleached kraft hardwood/softwood (50/50) pulp blend and filler or filler blends comprising polymeric vesiculated granules (PVG), precipitated calcium carbonate (PCC), and/or titanium dioxide ($TiO_2$). The hardwood pulp had a CSF of 400 mls and the softwood had a CSF of 600 mls. The PCC has an average particle size of 1.2 microns and has a scalenohedral crystal form. The retention aids were commercially available cationic and anionic polyacrylamides. The physical properties of the various handsheets were tested according to the following TAPPI standard test methods for paper:

| | |
|---|---|
| T220 OM-88 | Physical Testing of pulp handsheets |
| T403 OM-85 | Bursting Strength of Paper |

-continued

| | |
|---|---|
| T494 OM-88 | Tensile Strength |

The results are presented in Table B.

In Table B, handsheet number 16 which contains no pigment, filler or polymeric vesiculated granules and constitutes the fibrous material only, demonstrates superior physical properties to the other handsheets prepared. However, this handsheet would have the highest cost of all of the handsheets since it comprises pulp fibre only and, has the lowest C/R opacity.

The opacity of handsheets 1 to 15, which handsheets comprise calcium carbonate, titanium dioxide and/or polymeric vesiculated granules, are approximately equal, with opacity generally increasing as total filler level increases.

BRIEF DESCRIPTION OF THE DRAWINGS

In order to compare the effect of the polymeric vesiculated granules on the physical properties of the handsheets produced, graphs of the various properties versus total filler level are included in the Figures wherein.

Figure 1:
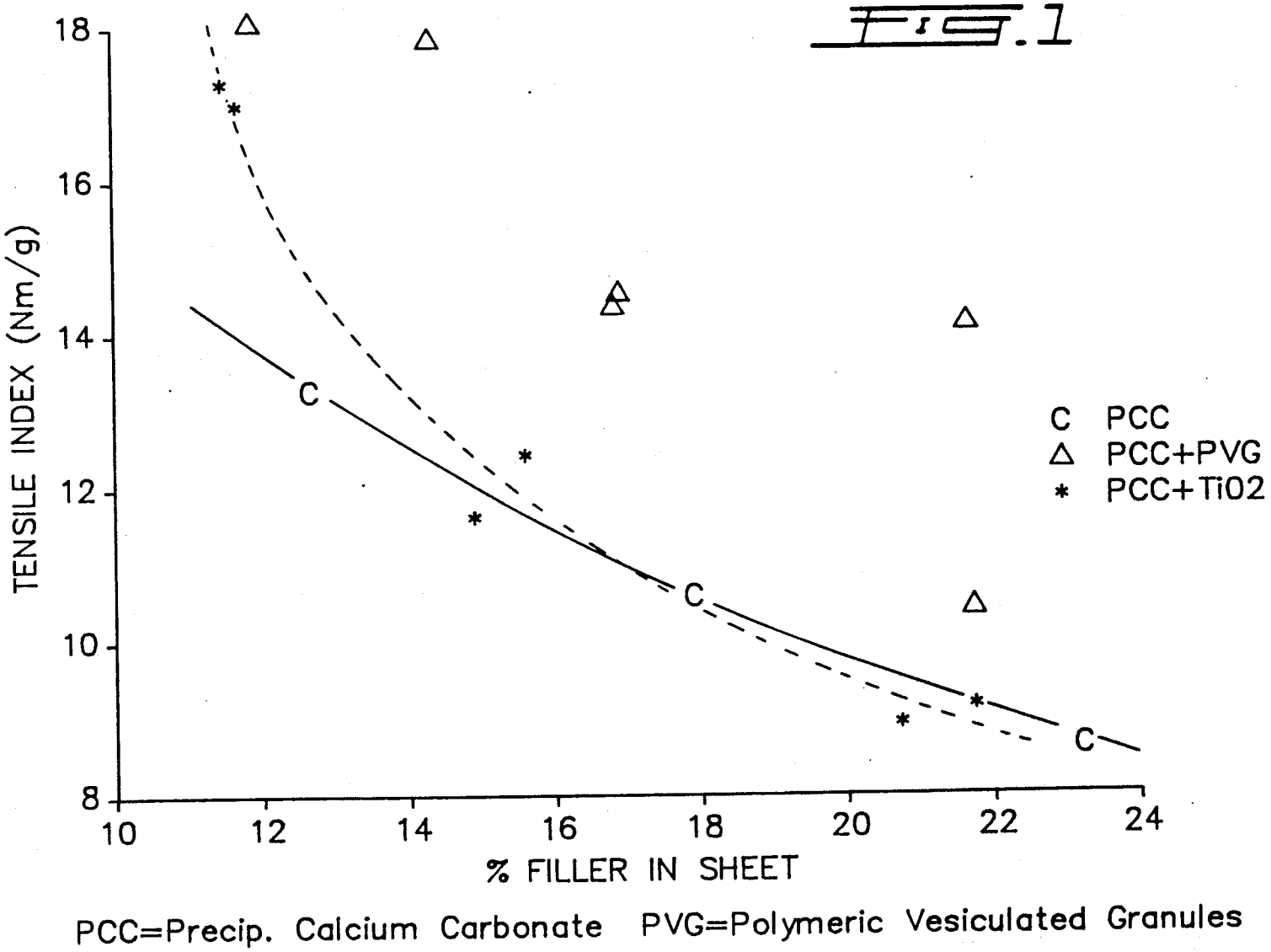
FIG. 1 is a graph of tensile index versus % filler.
Figure 2:
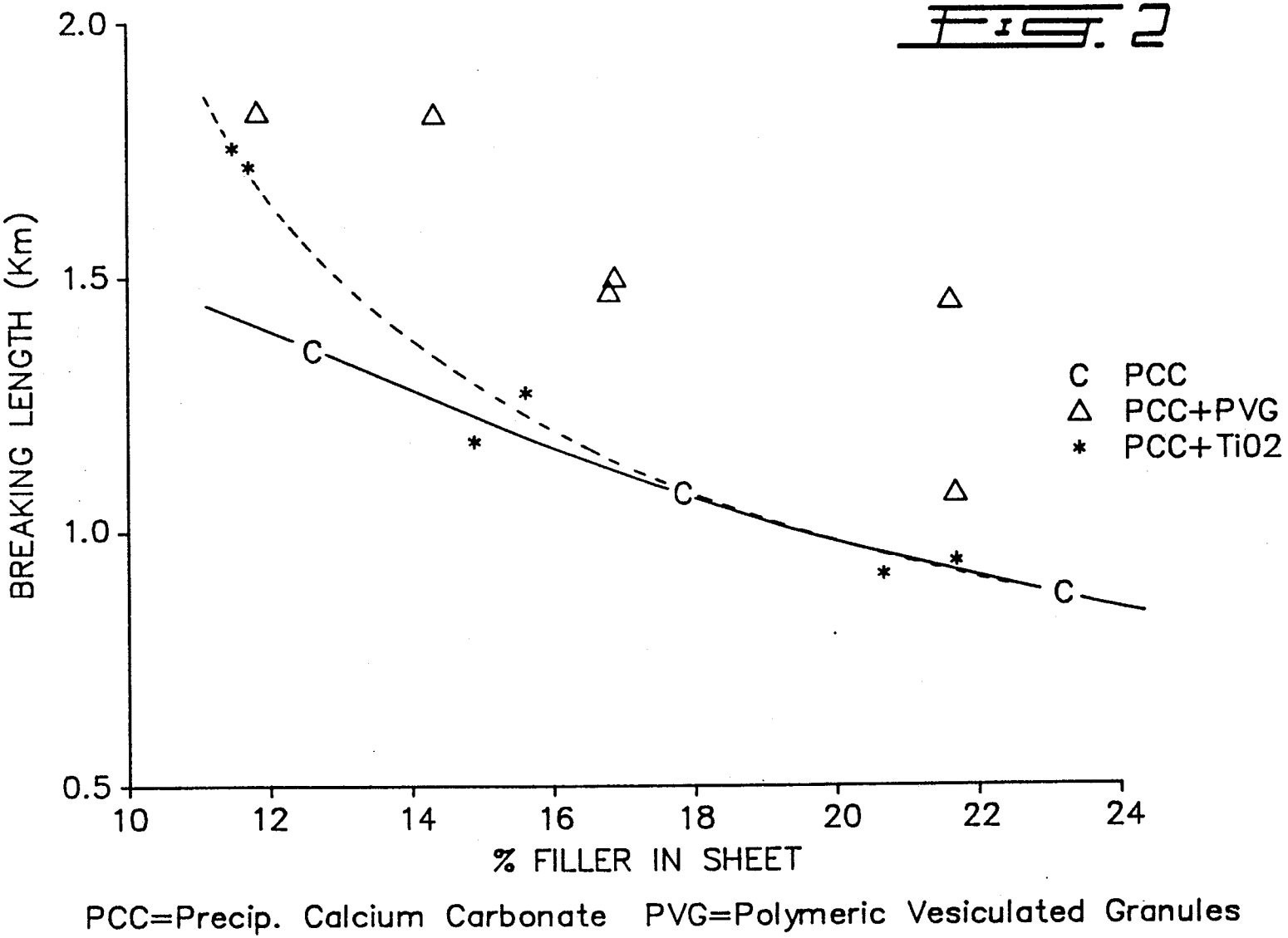
FIG. 2 is a graph of break length versus % filler.
Figure 3:
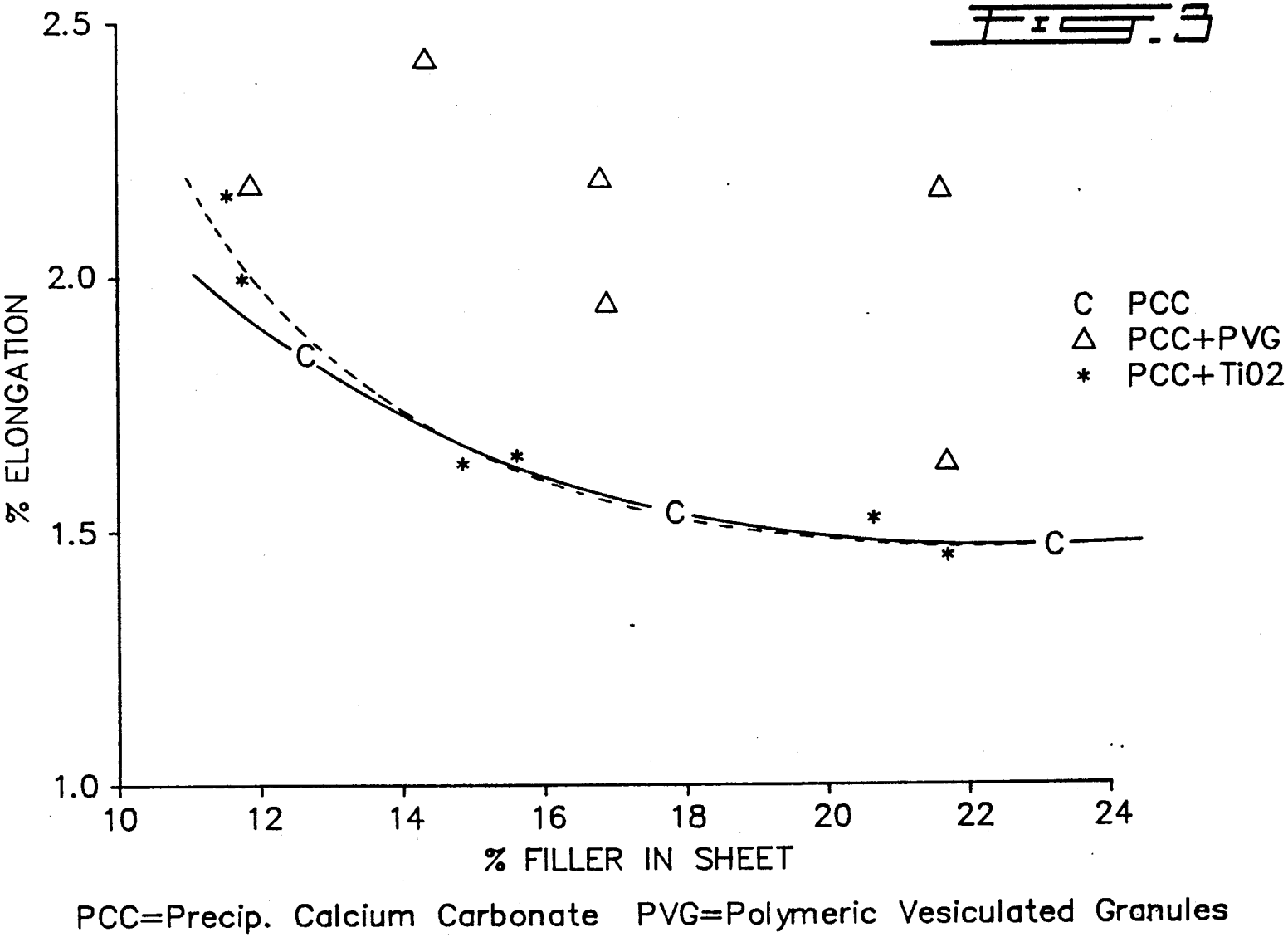
FIG. 3 is a graph of % elongation versus % filler.
Figure 4:
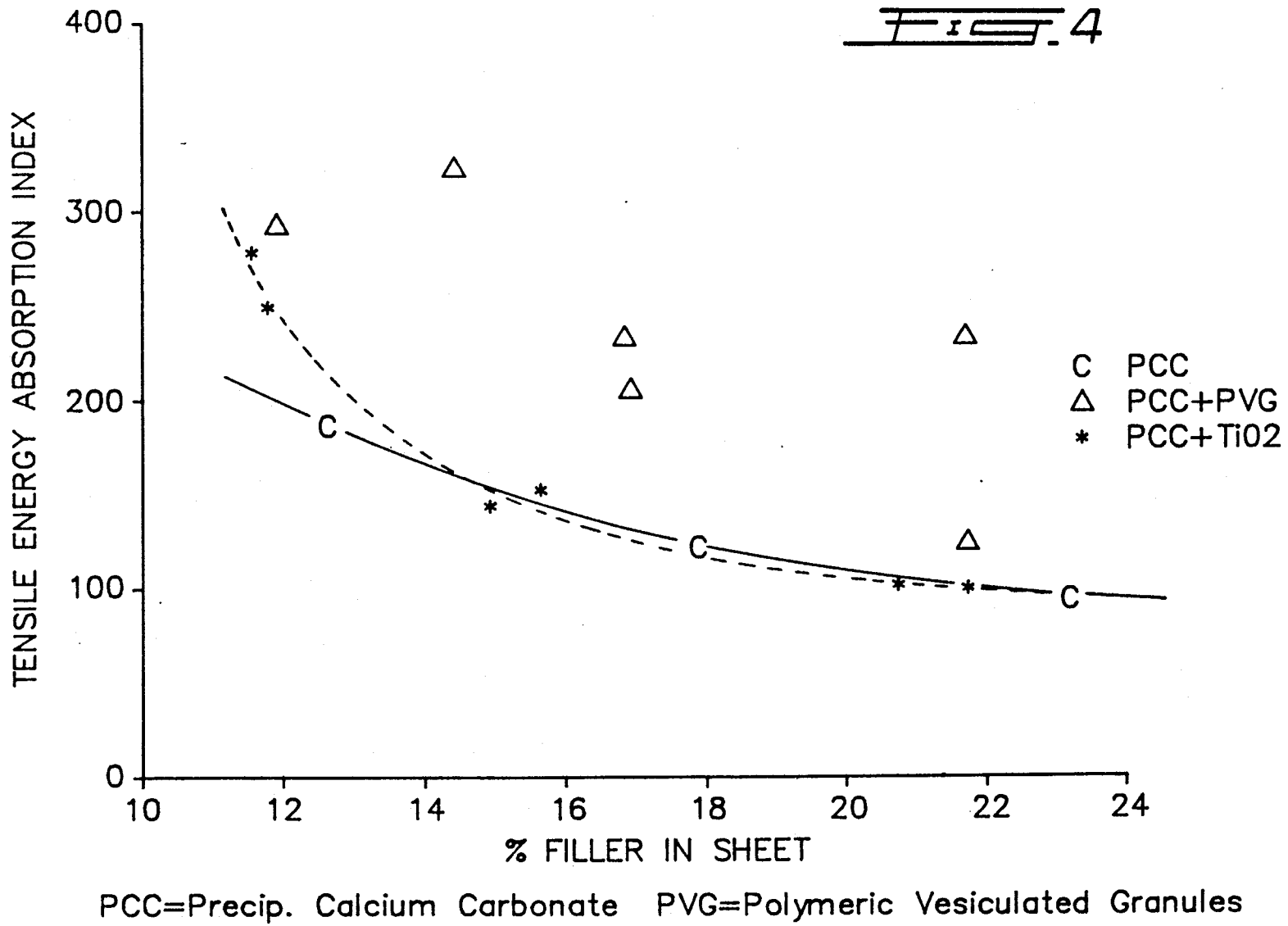
FIG. 4 is a graph of TEA index versus % filler.
Figure 5:
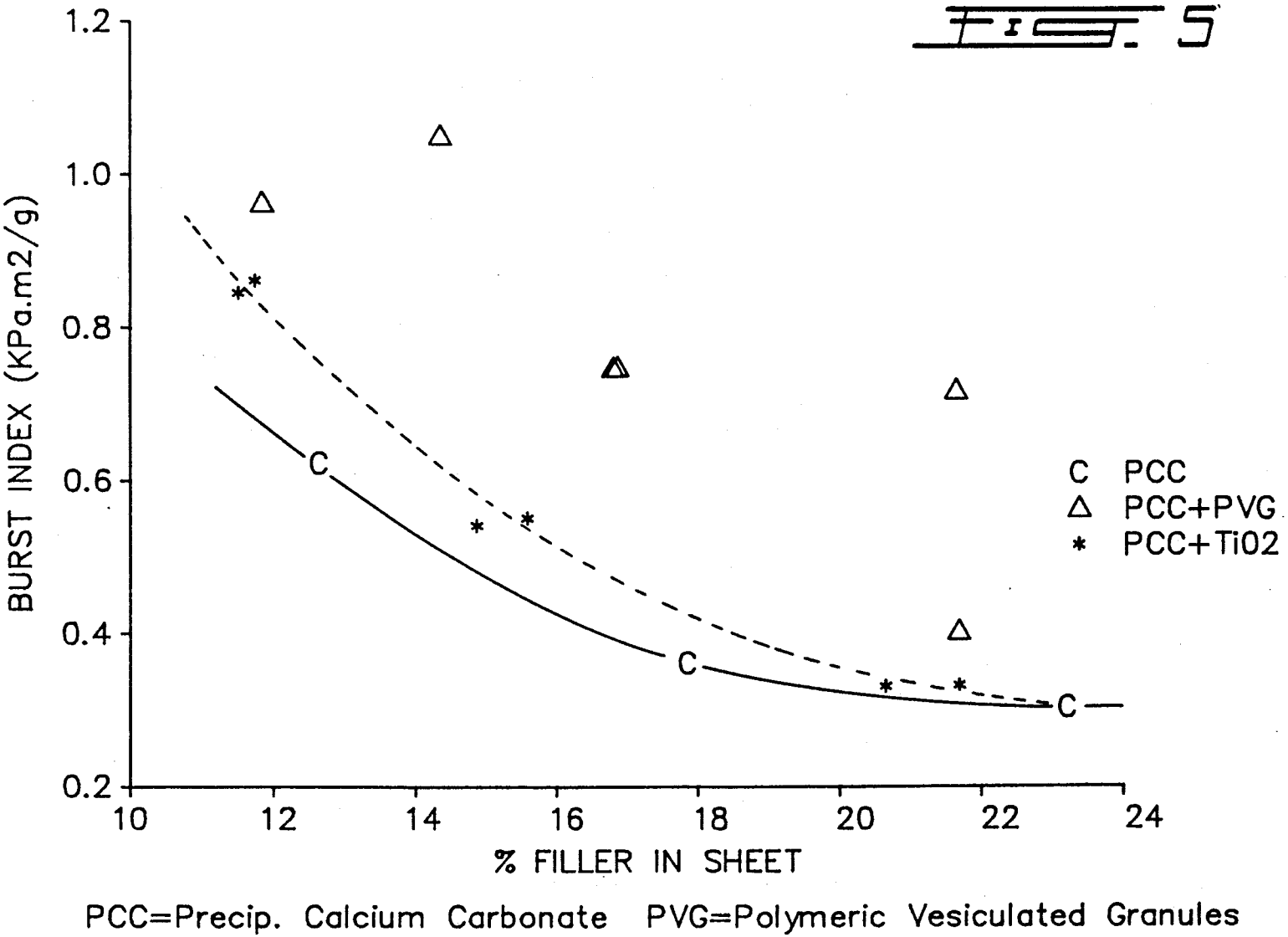
FIG. 5 is a graph of burst index versus % filler.
Figure 6:
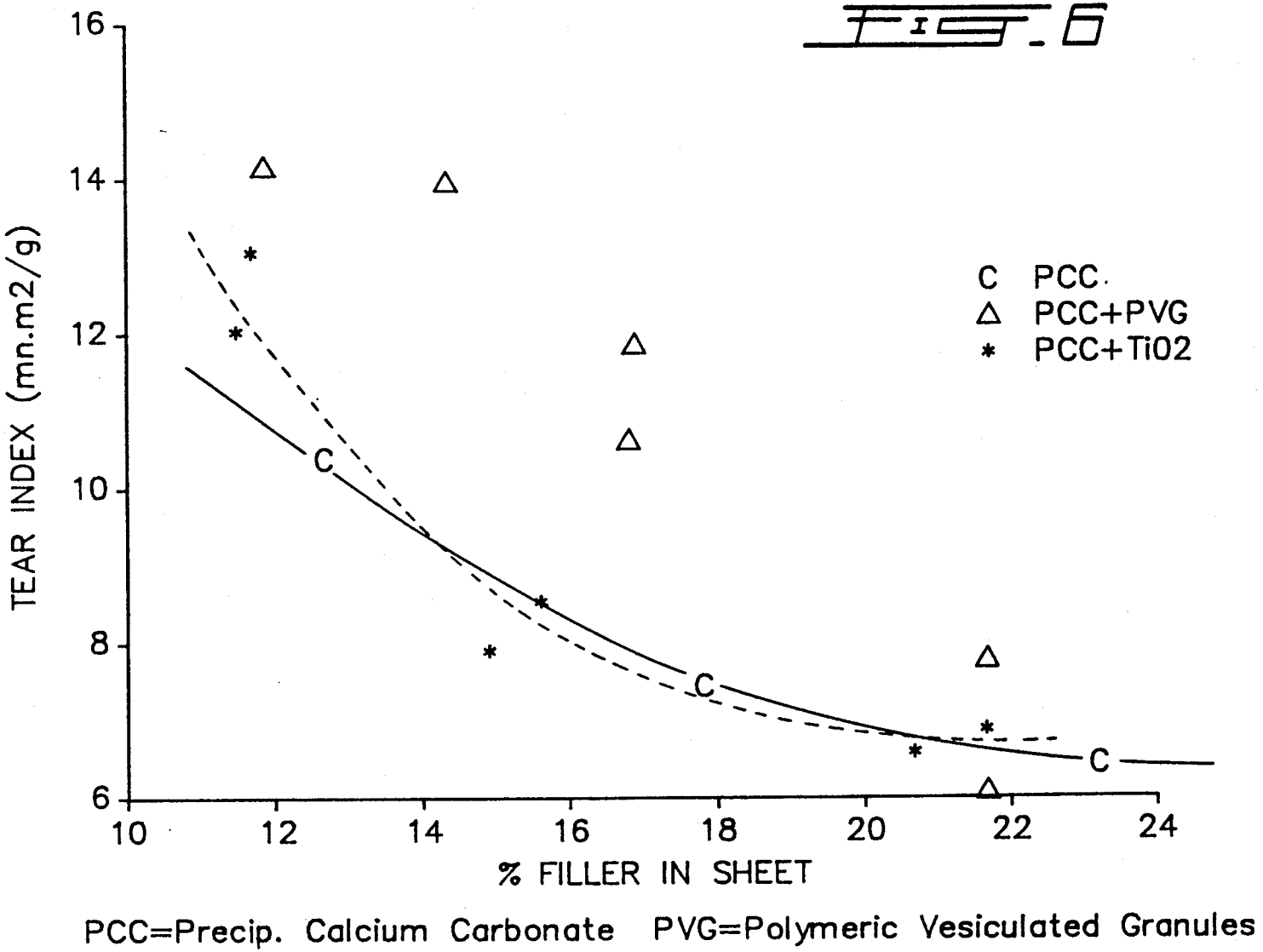
FIG. 6 is a graph of tear index versus % fillers.

Similarly in FIGS. 2 to 6, wherein the results obtained for break length, % elongation, TEA index, burst index, and tear index are shown versus the % filler level, the handsheets comprising the polymeric vesiculated granules were superior in almost all instances to the non-granule containing handsheets.

I claim:

1. An alkaline paper comprising a fibrous cellulosic material, 1.0 to 10.0% by weight of polymeric vesiculated granules, and 5 to 35% precipitated calcium carbonate filler, said granules having a mean diameter of 1 to 100 microns, the ratio of the granule to the mean vesicle diameter being at least 5:1, the maximum diameter of the vesicles being 20 microns, and the volume of the vesicles being from 5 to 95% of the volume of the granule.

2. A paper according to claim 1 wherein said granules have a mean diameter of 1 to 50 microns.

3. A paper according to claim 1 comprising 1.0 to 5.0% by weight of said granules.

4. A paper according to claim 1 comprising 10 to 25% by weight of calcium carbonate.

5. A paper according to any one of claims 1, or 2 additionally comprising a retention aid.

6. A paper according to any one of claims 1, or 2 additionally comprising conventional paper making fillers or pigments.

7. A method of improving the physical properties of an alkaline paper comprising:

TABLE B

| No. | % Total Filler[a] | PCC %[a] | PVG %[a] | $TiO_2$ %[a] | Tensile Index | Break Length | % Elongation | TEA Index | Burst Index | Tear Index | C/R Opacity |
|---|---|---|---|---|---|---|---|---|---|---|---|
| 1 | 11.97 | 10.65 | 1.32 | 0 | 17.96 | 1.82 | 2.18 | 289 | 0.96 | 14.15 | 92.3 |
| 2 | 14.43 | 11.94 | 2.49 | 0 | 17.72 | 1.81 | 2.42 | 322 | 1.05 | 13.96 | 93.6 |
| 3 | 16.93 | 15.84 | 1.09 | 0 | 14.51 | 1.48 | 1.94 | 204 | 0.74 | 11.90 | 92.4 |
| 4 | 16.85 | 14.84 | 2.01 | 0 | 14.33 | 1.46 | 2.19 | 232 | 0.74 | 10.63 | 93.9 |
| 5 | 21.75 | 20.91 | 0.84 | 0 | 10.36 | 1.06 | 1.63 | 122 | 0.40 | 6.07 | 94.6 |
| 6 | 21.69 | 19.97 | 1.72 | 0 | 14.10 | 1.44 | 2.17 | 231 | 0.72 | 7.71 | 94.0 |
| 7 | 11.80 | 10.39 | 0 | 1.41 | 16.93 | 1.72 | 2.00 | 248 | 0.86 | 13.05 | 93.6 |
| 8 | 11.58 | 9.30 | 0 | 2.28 | 17.19 | 1.75 | 2.16 | 276 | 0.85 | 12.08 | 93.3 |
| 9 | 15.64 | 14.79 | 0 | 0.85 | 12.32 | 1.26 | 1.64 | 149 | 0.53 | 8.49 | 94.1 |
| 10 | 14.89 | 13.38 | 0 | 1.51 | 11.49 | 1.17 | 1.63 | 141 | 0.54 | 7.89 | 93.7 |
| 11 | 20.70 | 19.81 | 0 | 0.89 | 8.88 | 0.91 | 1.52 | 99 | 0.33 | 6.56 | 94.6 |
| 12 | 21.71 | 19.83 | 0 | 1.88 | 9.10 | 0.93 | 1.44 | 97 | 0.33 | 6.87 | 93.2 |
| 13 | 12.69 | 12.69 | 0 | 0 | 13.20 | 1.35 | 1.84 | 183 | 0.62 | 10.33 | 93.5 |
| 14 | 17.85 | 17.85 | 0 | 0 | 10.49 | 1.07 | 1.53 | 119 | 0.36 | 7.39 | 93.7 |
| 15 | 23.22 | 23.22 | 0 | 0 | 8.56 | 0.87 | 1.46 | 92 | 0.30 | 6.43 | 94.4 |
| 16 | 0 | 0 | 0 | 0 | 23.31 | 2.38 | 3.07 | 551 | 1.56 | 17.18 | 89.6 |

[a] = % by weight in final sheet
Units:
Tensile Index: Nm/g
Break Length: Km
TEA Index (Tensile Energy Absorption): MJ/g
Burst Index: KPa · $m^2/g$
Tear Index: mN · $m^2/g$
Contrast Ratio (C/R) Opacity measured at 572 nm.

In FIG. 1, it can be seen that the tensile index of the handsheets tested generally decreases as filler level increases. The solid line shows the results obtained for handsheets 13 to 15 wherein the only filler used is precipitated calcium carbonate. The broken line indicates the tensile index of handsheets 7 to 12 which handsheets contain calcium carbonate and titanium dioxide. The remaining points shown in FIG. 1 are the tensile index results for the calcium carbonate and polymeric vesiculated granule containing handsheets, which handsheets are numbered 1 to 6 in Table B. It is clearly evident that these handsheets had better tensile strength than the non-granule containing handsheets at all levels of total filler.

preparing an aqueous mixture of a fibrous cellulosic material and 5 to 35%, by weight on solids of cellulosic material, of a precipitated calcium carbonate filler; and removing water from said mixture, to form an alkaline paper wherein the improvement comprises adding 1 to 10%, by weight on solids of cellulosic material, of polymeric vesiculated granules, said granules having a mean diameter of 1 to 100 microns, the ratio of the granule to the mean vesicle diameter being at least 5:1, the maximum diameter of the vesicles being 20 microns, and the volume of the vesicles being from 5 to 95% of the volume of the granule.

* * * * *